US005346125A

United States Patent [19]

Critzer, Sr.

[11] Patent Number: 5,346,125

[45] Date of Patent: Sep. 13, 1994

[54] DESIGNER MAILBOXES WITH REMOVABLE DECORATIVE SIDE PANELS

[76] Inventor: Randolph T. Critzer, Sr., 14325 Branched Antler Dr., Midlothian, Va. 23112

[21] Appl. No.: 198,292

[22] Filed: Feb. 18, 1994

[51] Int. Cl.[5] ..... B65D 91/00

[52] U.S. Cl. ..... 232/17; 232/38; 40/611

[58] Field of Search ..... 232/17, 38, 19, 1 C, 232/46; 40/306, 611

[56] References Cited

U.S. PATENT DOCUMENTS

| | | | |
|---|---|---|---|
| 512,350 | 1/1894 | Wollensak | 232/38 |
| 1,542,217 | 6/1925 | Cole | 232/17 |
| 2,561,007 | 7/1951 | Bierig | 232/17 |
| 4,260,090 | 4/1981 | Gross | 232/1 C |
| 4,756,106 | 7/1988 | Foster | 40/611 |
| 4,872,610 | 10/1989 | Grabowiecki | 232/38 |

*Primary Examiner*—Michael Milano
*Attorney, Agent, or Firm*—Michael J. Colitz, Jr.

[57] ABSTRACT

A designer mailbox with removable decorative side plates comprising a lower base plate in a generally rectangular configuration with parallel side edges and parallel front and rear edges; a semi-cylindrical roof panel having parallel lower edges located above the side edges of the base plate and extending from the front edge to the rear edge of the base plate; a pair of parallel planar interior side walls parallel with the side edges of the base plate and extending upwardly from the base plate at locations spaced inwardly from the side edges, the interior side walls having upper edges formed integrally with the roof panel interiorly of its lower edges; a pair of parallel exterior side walls extending upwardly from the side edges of the base plate to the lower edges of the roof panel and spaced a distance outwardly from the interior wall to thereby form generally rectangular spaces between the interior and exterior side walls; an opening in each exterior side wall extending from a horizontal lower edge parallel with the side edges of the base plate to a horizontal upper edge formed in the roof panel with parallel generally vertical edges therebetween; and a transparent insert positionable in each opening of the exterior wall, each insert being planar in its lower extent and curved in its upper extent to form a smooth curve continuation of the roof panel, each insert including generally L-shaped members with their longer legs positionable interiorly of the upper and lower edges defining the opening whereby a force by the user adjacent to the upper edges of either insert will effect sufficient deformation of the insert to effect its removal from the opening or its insertion thereto.

5 Claims, 2 Drawing Sheets

DESIGNER MAILBOXES WITH REMOVABLE DECORATIVE SIDE PANELS

BACKGROUND OF THE INVENTION

1. Field of the Invention

The present invention relates to designer mailboxes with removable decorative side panels and more particularly pertains to decorating the side panels of mailboxes through the use of removable panels.

2. Description of the Prior Art

The use of mailboxes with decorative features is known in the prior art. More specifically, mailboxes with decorative features heretofore devised and utilized for the purpose of decorating mailboxes to enhance their appearance are known to consist basically of familiar, expected, and obvious structural configurations, notwithstanding the myriad of designs encompassed by the crowded prior art which has been developed for the fulfillment of countless objectives and requirements.

The prior art discloses a large number of mailboxes with decorative features. By way of example, U.S. Pat. No. 4,244,512 to Wise discloses a mailbox with a transparent cover.

U.S. Pat. No. 4,872,610 to Grabowiecki discloses a display mailbox with interchangeable inserts.

U.S. Pat. No. 4,991,769 to Todd discloses a removable mailbox cover display.

U.S. Pat. No. 5,119,986 to Kobilarcik discloses a mailbox assembly with flag housing assembly.

Lastly, U.S. Pat. No. 5,143,285 to Wise discloses an illuminated mailbox support with photo-cell for enhanced illumination visibility.

In this respect, designer mailboxes with removable decorative side panels according to the present invention substantially depart from the conventional concepts and designs of the prior art, and in doing so provide an apparatus primarily developed for the purpose of decorating the side panels of mailboxes through the use of removable transparent panels.

Therefore, it can be appreciated that there exists a continuing need for new and improved designer mailboxes with removable decorative side panels which can be used to decorate the side panels of mailboxes through the use of removable transparent panels. In this regard, the present invention substantially fulfills this need.

SUMMARY OF THE INVENTION

In view of the foregoing disadvantages inherent in the known types of mailboxes with decorative features now present in the prior art, the present invention provides improved designer mailboxes with removable decorative side panels. As such, the general purpose of the present invention, which will be described subsequently in greater detail, is to provide new and improved designer mailboxes with removable decorative side panels and methods which have all the advantages of the prior art and none of the disadvantages.

To attain this, the present invention essentially comprises a new and improved designer mailbox with removable decorative side panels comprising, in combination, a lower base plate in a generally rectangular configuration with parallel side edges and parallel front and rear edges; a semi-cylindrical roof panel having parallel lower edges located above the side edges of the base plate and extending from the front edge to the rear edge of the base plate; a pair of parallel planar interior side walls parallel with the side edges of the base plate and extending upwardly from the base plate at locations spaced inwardly from the side edges, the interior side walls having upper edges formed integrally with the roof panel interiorly of its lower edges; a pair of parallel exterior side walls extending upwardly from the side edges of the base plate to the lower edges of the roof panel and spaced a distance outwardly from the interior wall to thereby form generally rectangular spaces between the interior and exterior side walls; an opening in each exterior side wall extending from a horizontal lower edge parallel with the side edges of the base plate to a horizontal upper edge formed in the roof panel with parallel generally vertical edges therebetween; a transparent insert positionable in each opening of the exterior wall, each insert being planar in its lower extent and curved in its upper extent to form a smooth curve continuation of the roof panel, each insert including generally L-shaped members with their longer legs positionable interiorly of the upper and lower edges defining the opening whereby a force by the user adjacent to the upper edges of either insert will effect sufficient deformation of the insert to effect its removal from the opening or its insertion thereto; a vertical back wall permanently coupling the base plate, interior and exterior side walls and roof panel at the rears thereof; a front wall pivotally secured at its lower edge to the side walls adjacent to the front thereof for opening and closing access to the interior of the mailbox between the interior side walls; and a plurality of removable decorative sheets positioned in the opening.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved designer mailboxes with removable decorative side panels which have all the advantages of the prior art mailboxes with decorative features and none of the disadvantages.

It is another object of the present invention to provide new and improved designer mailboxes with removable decorative side panels which may be easily and efficiently manufactured and marketed.

It is a further object of the present invention to provide new and improved designer mailboxes with removable decorative side panels which are of a durable and reliable construction.

An even further object of the present invention is to provide new and improved designer mailboxes with removable decorative side panels which are susceptible of a low cost of manufacture with regard to both materials and labor, and which accordingly are then susceptible of low prices of sale to the consuming public, thereby making such designer mailboxes with removable decorative side panels economically available to the buying public.

Still yet another object of the present invention is to provide new and improved designer mailboxes with removable decorative side panels which provide in the apparatuses and methods of the prior art some of the advantages thereof, while simultaneously overcoming some of the disadvantages normally associated therewith.

Even still another object of the present invention is to decorate the side panels of mailboxes through the use of removable transparent panels.

Lastly, it is an object of the present invention to provide a designer mailbox with removable decorative side plates comprising a lower base plate in a generally rectangular configuration with parallel side edges and parallel front and rear edges; a semi-cylindrical roof panel having parallel lower edges located above the side edges of the base plate and extending from the front edge to the rear edge of the base plate; a pair of parallel planar interior side walls parallel with the side edges of the base plate and extending upwardly from the base plate at locations spaced inwardly from the side edges, the interior side walls having upper edges formed integrally with the roof panel interiorly of its lower edges; a pair of parallel exterior side walls extending upwardly from the side edges of the base plate to the lower edges of the roof panel and spaced a distance outwardly from the interior wall to thereby form generally rectangular spaces between the interior and exterior side walls; an opening in each exterior side wall extending from a horizontal lower edge parallel with the side edges of the base plate to a horizontal upper edge formed in the roof panel with parallel generally vertical edges therebetween; and a transparent insert positionable in each opening of the exterior wall, each insert being planar in its lower extent and curved in its upper extent to form a smooth curve continuation of the roof panel, each insert including generally L-shaped members with their longer legs positionable interiorly of the upper and lower edges defining the opening whereby a force by the user adjacent to the upper edges of either insert will effect sufficient deformation of the insert to effect its removal from the opening or its insertion thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various FIGURES.

DESCRIPTION OF THE PREFERRED EMBODIMENT

Figure 1:
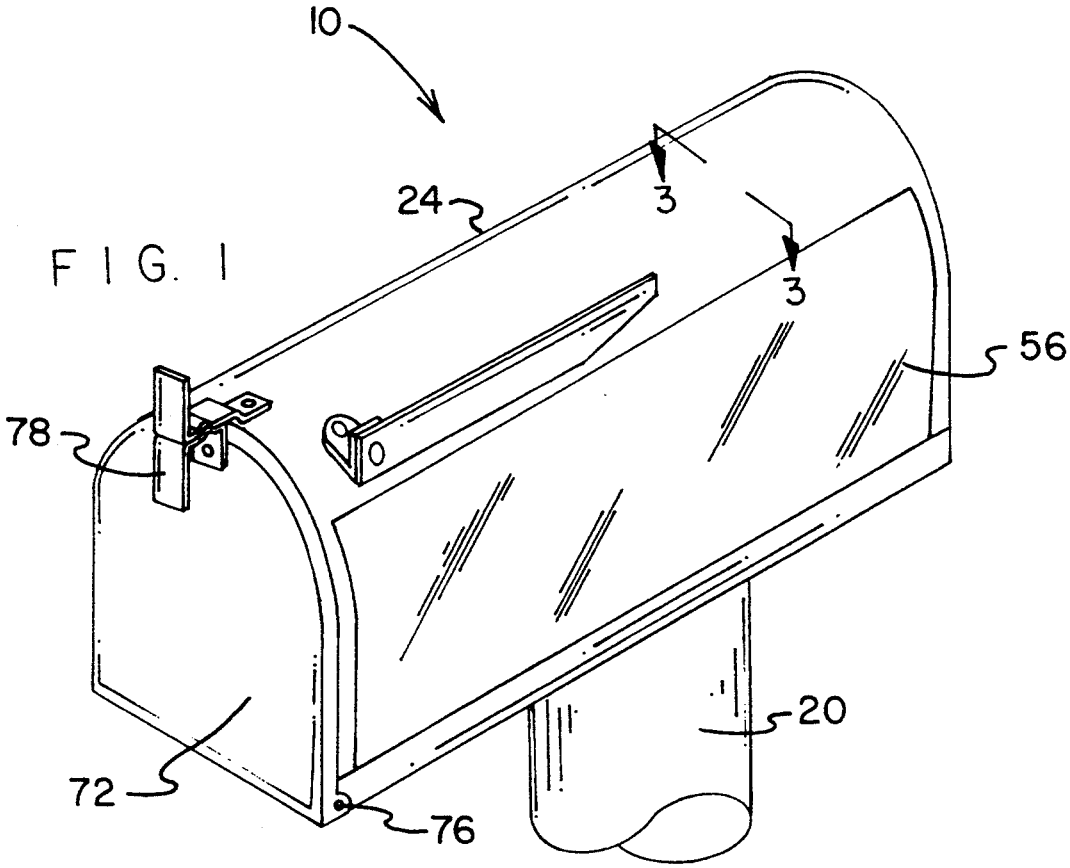
FIG. 1 is a perspective illustration of the preferred embodiment of the new and improved designer mailbox with removable decorative side panels constructed in accordance with the principles of the present invention.
Figure 2:
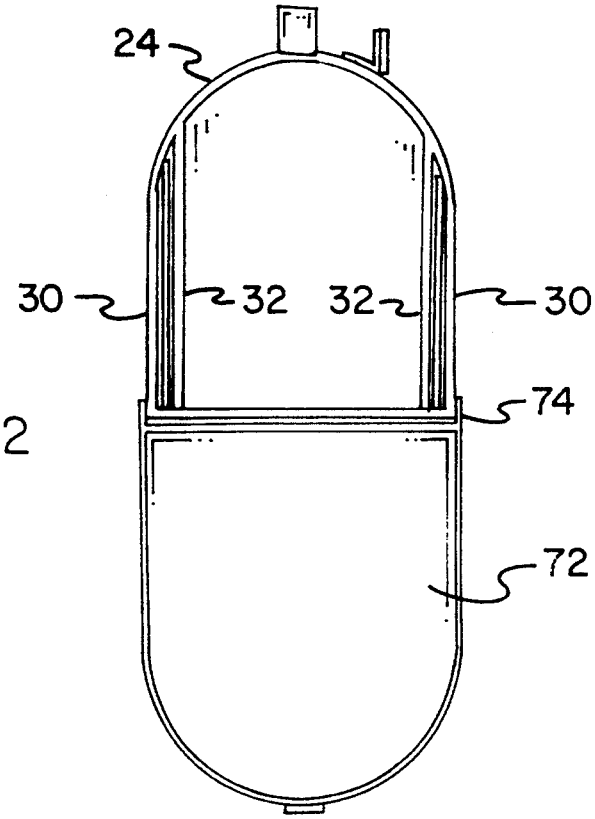
FIG. 2 is a front elevational view of the front of the mailbox shown in FIG. 1 but with the front panel open.
Figure 3:
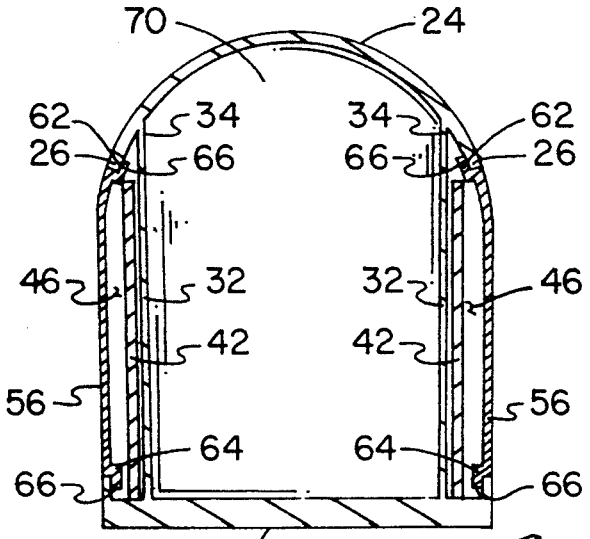
FIG. 3 is an enlarged sectional view of the mailbox taken along line 3—3 of FIG. 1.
Figure 4:
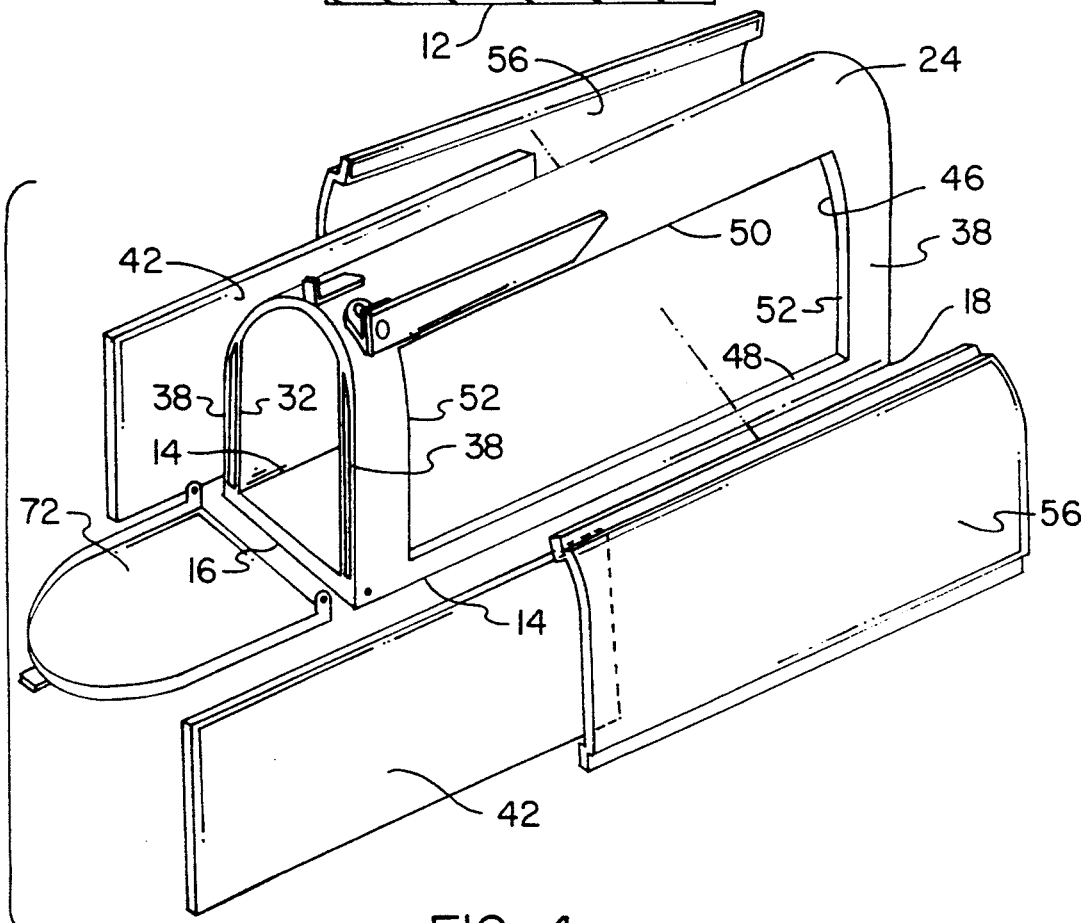
FIG. 4 is an exploded perspective view of the mailbox of the prior FIGURE.

With reference now to the drawings, and in particular to FIGS. 1 through 4 thereof, the preferred embodiment of the new and improved designer mailboxes with removable decorative side panels embodying the principles and concepts of the present invention and generally designated by the reference numeral 10 will be described.

Specifically, it will be noted in the various FIGURES that there are provided new and improved designer mailboxes with removable decorative side panels. In the broadest context, the invention includes a lower base plate, a semi-cylindrical roof panel, interior side walls, exterior side walls, an opening in each exterior wall, a transparent insert, a back panel, a front panel and a plurality of removable decorative panels used in association with the mailbox.

These component elements together are specifically configured and correlated one with respect to the other in order to attain the desired objectives.

More particularly, the first component of the mailbox is the lower base panel 12. The lower base panel is formed in a generally rectangular configuration. It has parallel side edges 14 and parallel front and rear edges 16 and 18. Articles to be positioned in the mailbox rest on the upper surface of the lower base panel. Further, the lower surface of the base panel is adapted to be supported by a post 20 for normal application. Their coupling mechanisms for support of the mailbox may be utilized.

Next provided is a semi-circular roof panel 24. Such roof panel is curved about an axis of the mailbox parallel with the plane of the base panel. The roof panel terminates at its lower extent at parallel lower edges 26. Such lower edges are located above the side edges of the base panel. The roof panel and its lower edges extends from the front edge to the rear edge of the base panel. The roof panel functions to preclude the elements from damaging contents within the mailbox located on the base panel.

Closure of the mailbox on its lateral sides is effected through pairs of parallel planar side walls 30. Such side walls include a pair of parallel planar interior side walls 32. Such interior side walls are formed parallel with each other and parallel with the side edges of the base panel. The interior side walls extend upwardly from the base plate at locations spaced inwardly from the side edges. The interior side walls also have upper edges 34 which are formed integrally with the roof panel at locations laterally interiorly of the lower edges of the roof panel.

Coupled with respect to the above described components are a pair of parallel exterior side walls 38. The exterior side walls extend upwardly from the side edges of the base plate. They extend upwardly to the lower edges of the roof panel and are formed integrally therewith. The exterior side walls are spaced a distance outwardly from the interior walls to thereby form thin, generally rectangular spaces between the interior and exterior side walls on opposite sides of the mailbox. This space therebetween is adapted to receive decorative sheets 42 for enhancing the appearance of the mailbox at its sides.

The components of the mailbox as described above form a generally cylindrical member which could be fabricated of a plurality of known materials through the extrusion process. Other forms of fabrication could readily be utilized.

In order to effect the insertion of and removal of the decorative sheets from the space between the side walls, an opening 46 is formed in each exterior side wall. Such opening extends from a horizontal lower edge 48 parallel with the side edges of the base plate to a horizontal upper edge 50 formed in the roof panel. Parallel generally vertical edges 52 extend therebetween. The size of the opening is sufficient to allow the insertion of or removal of the decorative sheet to the location between the interior and exterior side walls.

Access to the space between the side walls is effected through a transparent insert 56. Each insert is positionable in an opening 46 of the exterior wall. Each insert is generally planar in its lower extent with a curved surface in its upper extent. The curvature is such as to form a smooth continuation of the lower extent of the roof panel.

Each insert includes generally L-shaped locking members 62 and 64. Their longer legs 66 are positioned interiorly of the upper and lower edges of the exterior side panels which define the openings. Positioning and removal of the inserts is effected by a user applying a hand force adjacent to the upper edges of the inserts. Such force is in a downward direction to bow the center portion of the inserts outwardly. The deformation of the insert will be sufficient to effect its removal from the opening or its insertion thereof.

Closure of the mailbox is effected through a back wall and a front wall. The back wall 70 is a vertical member permanently coupled to the above described components of the mailbox. It is preferably transparent, or at least translucent, to allow light into the mailbox interior. More specifically, the periphery of the back wall is permanently coupled to the base plate, the interior and exterior side walls and the roof panel at the rear ends thereof. Similarly, the front wall 72 is located at the fronts of the base plate, interior and exterior side walls and roof panel. Coupling of the front wall is not permanently done at its periphery. Instead, the front wall is pivotally secured at its lower edge 74 to the side walls adjacent to the fronts thereof. Coupling is through hinges 76. This allows the grasping of a tab 78 at the upper edge of the front wall for pulling and pushing to open and close the mailbox to provide access to interior of the mailbox between the interior side walls.

The last component of the mailbox are the plurality of removable decorative sheets. Such sheets 42 are of a relatively stiff construction with drawings thereon to suit the aesthetic taste of the user. Such sheets are positionable between the interior and exterior side walls on opposite sides of the mailbox through the removal and insertion of the transparent insert.

The present invention is a mailbox that has regions on each side for the reception of inserts. The owner of this mailbox could change the decorative features at any time by simply sliding the old ones out and sliding in the new ones. He could choose from a complete line of inserts, as for example, outdoor scenery, wildlife, and holiday themes. Other products have the scenes painted on the mailbox or have them on plastic which is attached. The present invention would allow the owner to change the scenes on his mailbox whenever he wanted.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved designer mailbox with removable decorative side panels comprising, in combination:

a lower base plate in a generally rectangular configuration with parallel side edges and parallel front and rear edges;

a semi-cylindrical roof panel having parallel lower edges located above the side edges of the base plate and extending from the front edge to the rear edge of the base plate;

a pair of parallel planar interior side walls parallel with the side edges of the base plate and extending upwardly from the base plate at locations spaced inwardly from the side edges, the interior side walls having upper edges formed integrally with the roof panel interiorly of its lower edges;

a pair of parallel exterior side walls extending upwardly from the side edges of the base plate to the lower edges of the roof panel and spaced a distance outwardly from the interior wall to thereby form generally rectangular spaces between the interior and exterior side walls;

an opening in each exterior side wall extending from a horizontal lower edge parallel with the side edges of the base plate to a horizontal upper edge formed in the roof panel with parallel generally vertical edges therebetween;

a transparent insert positionable in each opening of the exterior wall, each insert being planar in its lower extent and curved in its upper extent to form a smooth curve continuation of the roof panel, each insert including generally L-shaped members with their longer legs positionable interiorly of the upper and lower edges defining the opening whereby a force by the user adjacent to the upper edges of either insert will effect sufficient deformation of the insert to effect its removal from the opening or its insertion thereto;

a vertical back wall permanently coupling the base plate, interior and exterior side walls and roof panel at the rears thereof;

a front wall pivotally secured at its lower edge to the side walls adjacent to the front thereof for opening and closing access to the interior of the mailbox between the interior side walls; and a plurality of removable decorative sheets positioned in the opening.

2. A designer mailbox with removable decorative side plates comprising:

a lower base plate in a generally rectangular configuration with parallel side edges and parallel front and rear edges;

a semi-cylindrical roof panel having parallel lower edges located above the side edges of the base plate and extending from the front edge to the rear edge of the base plate;

a pair of parallel planar interior side walls parallel with the side edges of the base plate and extending upwardly from the base plate at locations spaced inwardly from the side edges, the interior side walls having upper edges formed integrally with the roof panel interiorly of its lower edges;

a pair of parallel exterior side walls extending upwardly from the side edges of the base plate to the lower edges of the roof panel and spaced a distance outwardly from the interior wall to thereby form generally rectangular spaces between the interior and exterior side walls;

an opening in each exterior side wall extending from a horizontal lower edge parallel with the side edges of the base plate to a horizontal upper edge formed in the roof panel with parallel generally vertical edges therebetween; and a transparent insert positionable in each opening of the exterior wall, each insert being planar in its lower extent and curved in its upper extent to form a smooth curve continuation of the roof panel, each insert including generally L-shaped members with their longer legs positionable interiorly of the upper and lower edges defining the opening whereby a force by the user adjacent to the upper edges of either insert will effect sufficient deformation of the insert to effect its removal from the opening or its insertion thereto.

3. The mailbox as set forth in claim 2 and further including:

a vertical back wall permanently coupling the base plate, interior and exterior side walls and roof panel at the rears thereof.

4. The mailbox as set forth in claim 2 and further including:

a front wall pivotally secured at its lower edge to the side walls adjacent to the front thereof for opening and closing access to the interior of the mailbox between the interior side walls.

5. The mailbox as set forth in claim 2 and further including:

a plurality of removable decorative sheets positioned in the opening.

* * * * *